United States Patent [19]

Pelka et al.

[11] 4,361,767

[45] Nov. 30, 1982

[54] APPARATUS AND METHOD FOR CONTROLLING ELECTRICAL EQUIPMENT

[75] Inventors: David C. Pelka; Baron O. A. Grey, both of Inglewood, Calif.

[73] Assignee: National Technical Systems, Encino, Calif.

[21] Appl. No.: 133,348

[22] Filed: Mar. 24, 1980

[51] Int. Cl.[3] ..... G08B 13/16

[52] U.S. Cl. ..... 307/117; 340/565; 315/360

[58] Field of Search ..... 307/116, 117, 118; 340/565, 566, 573, 517; 328/1, 5; 361/179; 315/291, 360

[56] References Cited

U.S. PATENT DOCUMENTS

| | | | |
|---|---|---|---|
| 2,433,845 | 1/1948 | Hayes et al. | 340/566 X |
| 3,459,961 | 8/1969 | Ravas | 307/116 |
| 3,922,663 | 11/1975 | Lubke et al. | 307/117 X |
| 4,099,168 | 7/1978 | Kedjierski et al. | 340/517 |
| 4,196,423 | 1/1980 | Carver et al. | 340/566 |

*Primary Examiner*—G. Z. Rubinson
*Assistant Examiner*—James L. Dwyer
*Attorney, Agent, or Firm*—Robert J. Schaap

[57] ABSTRACT

An apparatus and method for automatically de-energizing electrically operable equipment in response to a lack of animal activity in a specified environment for predetermined time period. The apparatus of the present invention utilizes a circuit which is designed to detect activity which generates energy in a certain wavelength range and particularly, sonic energy in a certain environment and is responsive to the lack of activity within a certain predetermined time delay period or interval. Thus, if an activity which generates sonic energy is detected within a confined environment within the predetermined time interval, a signal is generated to energize or maintain energization of one or more electrical devices connected to the system of the invention. Contrariwise, if no sonic energy is detected within the predetermined time interval, there is a resultant de-energization of the electrically operable equipment. A control is provided to adjust the predetermined time delay period. The electrically operable equipment may adopt the form of a switch which de-energizes lights, air conditioning equipment or the like. Means can also be provided for adjusting the sensitivity of the device to account for background noise and the like.

54 Claims, 5 Drawing Figures

APPARATUS AND METHOD FOR CONTROLLING ELECTRICAL EQUIPMENT

BACKGROUND OF THE INVENTION

This invention relates in general to certain new and useful improvements for automatically de-energizing power utilizing equipment after a lack of animal activity for a predetermined time period, and more particularly, to an apparatus and method capable of de-energizing electrically operable equipment if animal activity has not generated energy in a certain spectral wavelength in a particular environment within predetermined time period and thereafter permitting energization of such equipment if animal activity is so detected.

As a result of fossil fuel shortage, strong opposition to nuclear generated electrical power, and economic unavailability of other forms of power, e.g. geothermal power and the like, there has been a strong need for energy saving devices. Further, as a result of recent energy shortage conditions, there has also been a number of relatively recently proposed energy savings devices. Many of these devices are not highly effective. Other types of energy savings devices while they may be effective, are oftentimes complex, difficult to effectively operate and are not economically feasible.

There have been several prior art detection systems designed to detect human activity in a specified environment as for example, a room or other enclosure. One such prior art device utilized a source of microwave radiation. Thus, if there was human activity within the specified environment the microwave radiation would cause a triggering of a signal to energize or de-energize electrically operable equipment.

There have been other forms of human detection systems to detect human activity, as for example, passing through a doorway or across some barrier or threshold. One such detection system used a light beam and light sensor such that breaking of the beam would cause initiation of an electrical signal. Thus, the passage of a person through a doorway would initiate an electrical signal to operate some electrically operable equipment, e.g. would trigger an alarm or otherwise cause the door open.

The prior art is replete with a number of burglar alarm systems, burglar deterrent timing circuits, and the like. Exemplary of such circuits are the Stettner et al. U.S. Pat. No. 3,761,912 in which a timing circuit is used in connection with a silicon controlled rectifier for generating an alarm or energizing lights for a selected period of time in response to the occurrence of a sound. However, after a substantial period of time, the circuit is de-energized and turns off the lights and/or sound. However, in accordance with conventional burglar alarm systems or other intrusion devices, the alarm would be generated almost immediately after detection of the sound.

U.S. Pat. No. 4,012,732 to Herrick also discloses a security device in which an alarm is actuated after a predetermined time period of no physical activity. The circuit utilizes a means to sense an inanimate object as well as an animate object and relies upon a clocking system to actuate an alarm after a predetermined period of inactivity.

The White et al. Pat. No. 3,445,836 also discloses an alarm system which operates by means of audio frequency signals and includes a plurality of sound actuated sensors. The circuit includes various amplifiers and pre-amplifiers in order to generate an alarm in response to an ambient noise condition. The Kedjierski et al. U.S. Pat. No. 4,099,168 similarly discloses an intrusion alarm system which operates on the basis of an audio frequency signal.

Heretofore, there has not been any known effective system for electrically de-energizing electrically operable equipment when a lack of animal activity, such as human activity, is detected or sensed for a predetermined time period, and preferably a user adjustable time period, and in a specified environment.

There has been at least one proposed system using ultrasonic radiation in a specified environment for sensing the presence of or a lack of human activity. In this case, the ultrasonic radiation was generated as a type of standing wave such that if the wave was not disturbed, then equipment could be automatically de-energized. Any disturbance in the standing wave would cause a re-energization of the equipment. A similar system has been proposed used with a standing wave of microwave radiation. This latter proposed system also would operate in a similar manner.

Each of the aforementioned proposed systems were not passive in that it was necessary to generate a standing wave or at least a type of standing wave in order to detect the presence or lack of presence of animal activity. Moreover, by their very nature, these systems were sensitive in that even a small insect could disturb the standing wave thereby causing an undesirable triggering of the system.

OBJECTS OF THE INVENTION

It is, therefore, a primary object of the present invention to provide an apparatus which is capable of sensing energy within a certain wavelength range generated as a result of animal activity and in a particular environment for a predetermined time interval.

It is another object of the present invention to provide an apparatus of the type stated which is effectively operable to detect energy within a sonic wavelength range and thereby generate an electrical signal which is capable of causing deactivation of electrically operable equipment as the result of no activity in a specified environment.

It is a further object of the present invention to provide an apparatus of the type stated in which the predetermined time interval can be manually altered in order to adjust the time lapse before the electrically operable equipment is de-energized.

It is an additional object of the present invention to provide an apparatus of the type stated which is operable to detect various types of activity which could cause de-energization of electrically operable equipment.

It is yet another object of the present invention to provide an apparatus of the type stated which permits adjustment for background noise conditions and like conditions.

It is also an object of the present invention to provide a method of automatically de-energizing electrically operable equipment in response to lack of activity which generates a signal in a certain wavelength range in a specified environment, and within a predetermined time interval.

It is still another salient object of the present invention to provide an apparatus of the type stated which is highly effective and passive in its operation, easy to use and which can be manufactured at a relatively low cost.

With the foregoing and other objects in view, our invention resides in the novel features of form, construction, arrangement, and combination of parts presently described and pointed out in the claims.

BRIEF SUMMARY OF THE DISCLOSURE

An apparatus for detecting the presence of animal activity or the lack of animal activity in a specified environment and during a predetermined time interval. The apparatus is designed to control energization and de-energization of equipment, preferably electrically operable equipment. If animal activity is not detected in the specified environment within the predetermined time interval, then the apparatus is effective to de-energize the electrically operable equipment in order to provide at least energy savings. On the other hand, if the animal activity is detected in the specified environment, the apparatus is designed to permit energization, or otherwise, to maintain energization of the electrically operable equipmemt. In this way, the apparatus of the present invention functions as a so-called "intelligent switch".

The apparatus of the invention could be operable to provide other forms of responsive action. While the apparatus in and of itself may function as a switch, it could provide a responsive action to other forms of equipment. Thus, it could be designed to interfere with the providing of a source of power to other operable equipment. For example the apparatus could be designed to function as a switch or type of valve mechanism controlling the flow of the fuel to fuel operative equipment. Thus, in this respect, the apparatus of the present invention is not limited to use only with electrically operable equipment although it is highly effective for use with electrically operable equipment.

The apparatus of the invention includes an analog circuit portion and a digital circuit portion. The analog circuit portion is designed to provide for the detection of energy within a specified wavelength range which results from animal activity. Particularly, and in a preferred embodiment, the energy which is generated is within the sonic wavelength range. The sonic wavelength range is deemed for the purposes of this invention to include the subsonic wavelength as well as super-sonic wavelength. The analog circuit portion will therefore include a sensor mechanism, such as a microphone, or the like, in order to detect sound within a specified environment, such as a room or the like, which constitutes a defined volume. The analog circuit portion may also include band pass filters, gain amplifiers and the like in order to process the signal for further use in the digital portion of the circuit, as hereinafter described.

The animal activity in accordance with the present invention, is preferably human activity. Moreover, the specific area or environment is preferably an enclosed environment or limited environment. The human or other animal activity is detected by the registration of a noise level (spectral signature) above a user-adjustable threshold level and within a predefined spectral bandwidth. The user-adjustable threshold level is preferably manually operable or adjustable in connection with the present invention.

A pulse shaper, such as a Schmitt trigger inverter is used as an interface between the analog portion and the digital portion of the circuit. This Schmitt trigger acts as a discretizer to provide output pulses in a form which are compatible with and capable of being effectively used by the digital portion of the circuit. This pulse shaper is hereinafter described in more detail.

In one aspect of the present invention, the digital portion of the circuit includes clocking circuit means to provide a predetermined time interval in order to enable a determination of whether or not the activity occured in the predetermined time interval. The circuit further includes a first counter means in order to initiate a counting operation for detection of an animal activity in the predetermined time interval and specified environment. The circuit further comprises a second counter means connected to the first counter means in order to determine whether or not the first counter means counted to the predetermined time interval.

More specifically, the system of the present invention senses the presence or absence of human activity within a defined volume by registering the spectral signatures above the user-adjustable threshold level and within the spectral bandwidth. Upon detection of signal above this threshold level within a predetermined time period, the noise is used to activate a built-in-user selectable time delay mechanism. The output of the system is an electrical impulse and may be used to activate or deactivate electrical devices or systems connected to the system of the present invention.

As a specific example, if the user of the invention selects the noise threshold level appropriate to the environment and sets the time delay at a specific interval, e.g., ten minute intervals, the system will now moniter for noise characteristics of human activity within the specified volume, (e.g., the specified environments). If no noise is registered there will be no inputs over this ten minute time interval. Consequently, the system will shut off all lights, air-conditioning, stereo or other electrically operable devices that may be connected to the system of the invention. On the other hand, if the system of the invention does register a noise input during the ten minute or other time interval and above the threshold level, it will automatically reset its timing circuit to zero and thereby energize all of the electrically operable equipment connected thereto and thereby restart the process.

In accordance with the above, as long as there is no human or other animal activity occurring within the specified environment and within the predetermined time interval, all electrically operable equipment is allowed to be de-energized. If the apparatus of the invention has effectively caused de-energization of the electrically operable equipment because the given time interval has been exceeded, it continues to search for noise inputs on a continuous basis which exceeds the threshold level. Consequently, as soon as a noise level is detected within the specified environment and exceeding a certain threshold level, the circuit is reactivated. In this case, the circuit acts as an intelligent controller in order to turn on or activate a given activity, e.g., a turning on of lights, motors or the like.

The apparatus of the invention is also passive in that it does not generate any form of standing wave or other signal form. In fact, it is passive in the sense that it does not generate any signal which must be detected or interrupted in order for the apparatus to be operative.

The apparatus may also be provided, in one aspect with a sensitivity control in order to adjust the sensitivity of the apparatus to account for background noise, or the like.

As indicated previously, the apparatus of the invention is effective to turn electrically operable equipment off after a certain predetermined time interval which constitutes a threshold time level. The "predetermined" time interval is a time interval or time period which may be manually set in the apparatus itself by a manually operable control, such as a potentiometer, as hereinafter described. The term "predetermined" time interval will, of course, also include fixed time intervals which could vary from apparatus to apparatus, and which could be the same in each apparatus and which could also be factory-set.

The predetermined time interval in the apparatus of the present invention will be an appreciable time interval or time period, at least compared to a standard burgular alarm system. In the conventional burgular alarm, quite obviously, the alarm is designed to be activated or initiated as soon as an intrusion is detected. In the apparatus of the present invention, there will be an appreciable delay which is usually one minute or longer, and typically, the appreciable delay will be considerably longer than one minute, e.g., in the range of ten to fifteen minutes or longer. Thus, with a time delay of ten to fifteen minutes, if no activity is sensed within this predetermined time period, then the apparatus will automatically de-energize the electrically operable equipment which is operably connected thereto.

The apparatus of the invention is essentially a so-called "intelligent" apparatus or "intelligent switch" as aforesaid. The apparatus is intelligent at least in the sense that it is capable of making a decision, even though it may be a somewhat elementary decision making process. In essence, the apparatus effectively searches for human or other animal activity at all times and automatically initiates and energizes the equipment when detecting the presence of the animal activity. Further, the apparatus effectively monitors a lack of animal activity, at least, within the predetermined time period and thereby makes a decision to effectively de-energize the electrical operable equipment when no animal activity has occurred within the specified environment and in the predetermined time interval.

In this respect, it should be understood that other forms of decision making apparatus or the so-called "intelligent components" could be used with or to modify the apparatus of the invention. For example, the apparatus is uniquely adapted so that it is capable of effectively being operated with programmed logic utilizing a form of microprocessors as opposed to the random logic circuit as described herein. In this way, the circuitry could be software programmed to make the necessary decisions which are now being made by the random logic in the apparatus of the invention. Decision making software program logic of this type could be designed to average out background noise in an accurate manner and account for the existence of such background noise.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
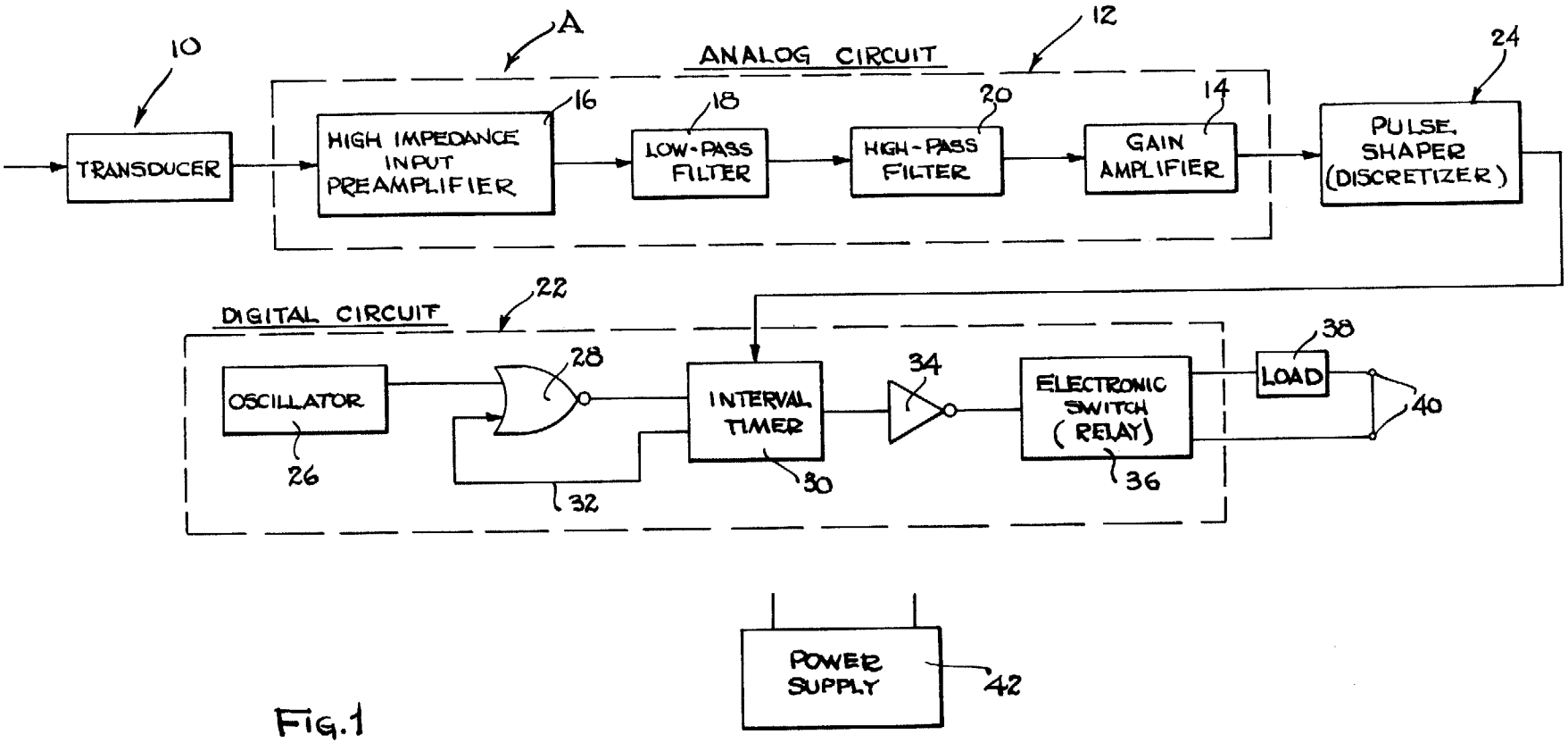
Figure 5:
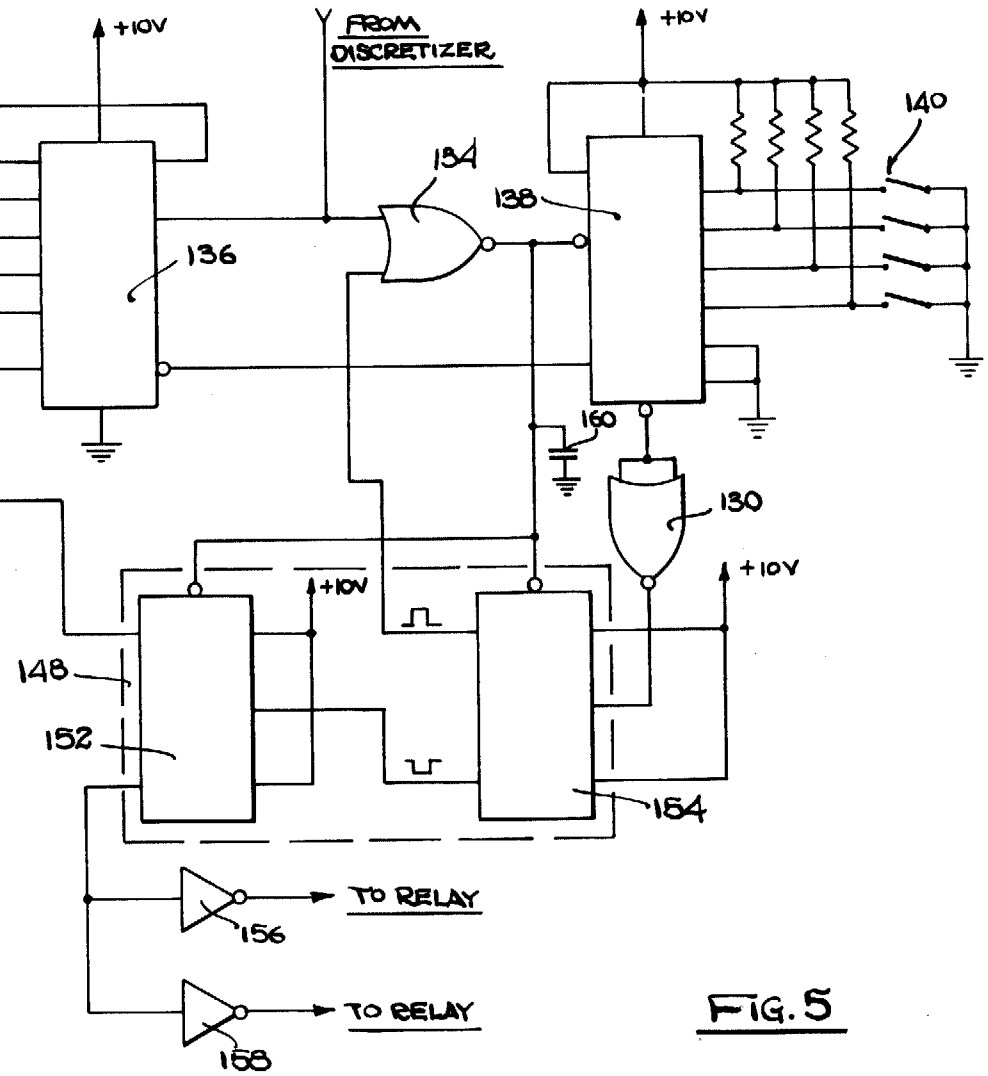
Figure 2:
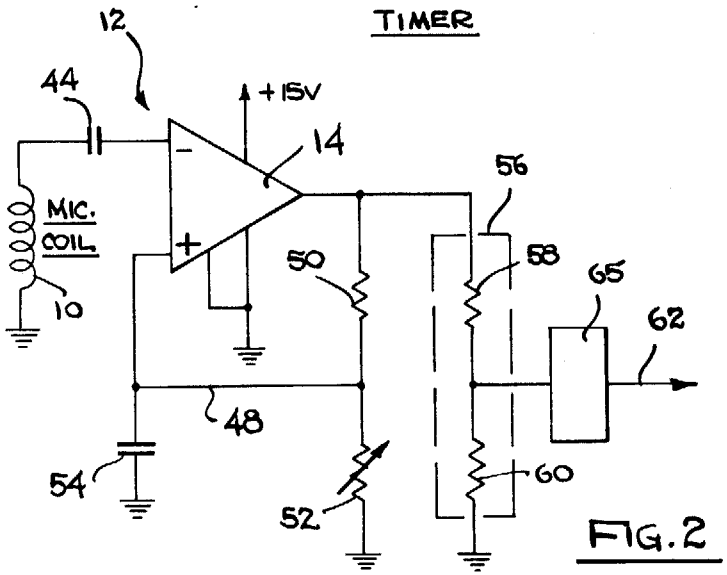
Figure 3:
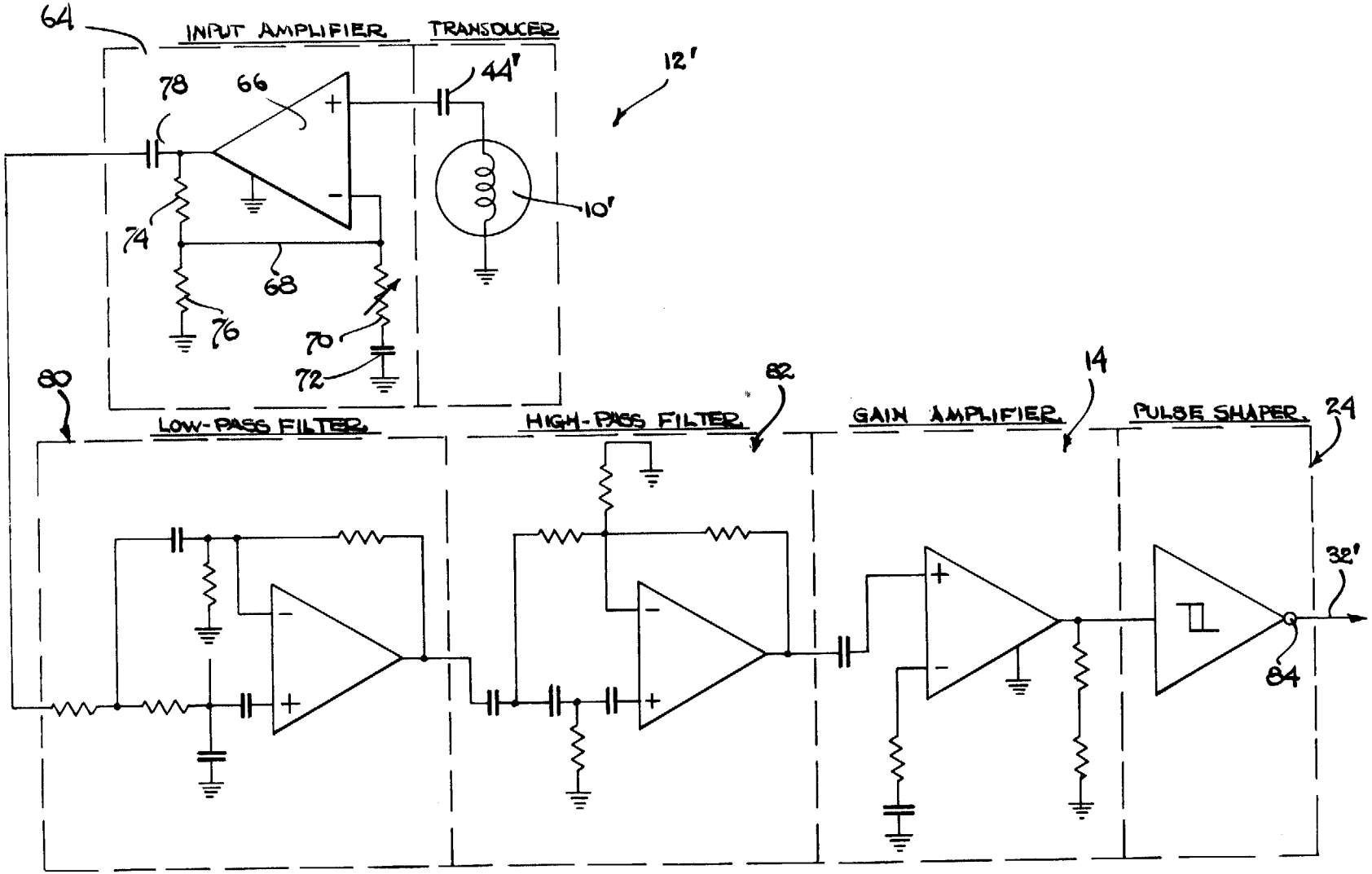
Figure 4:
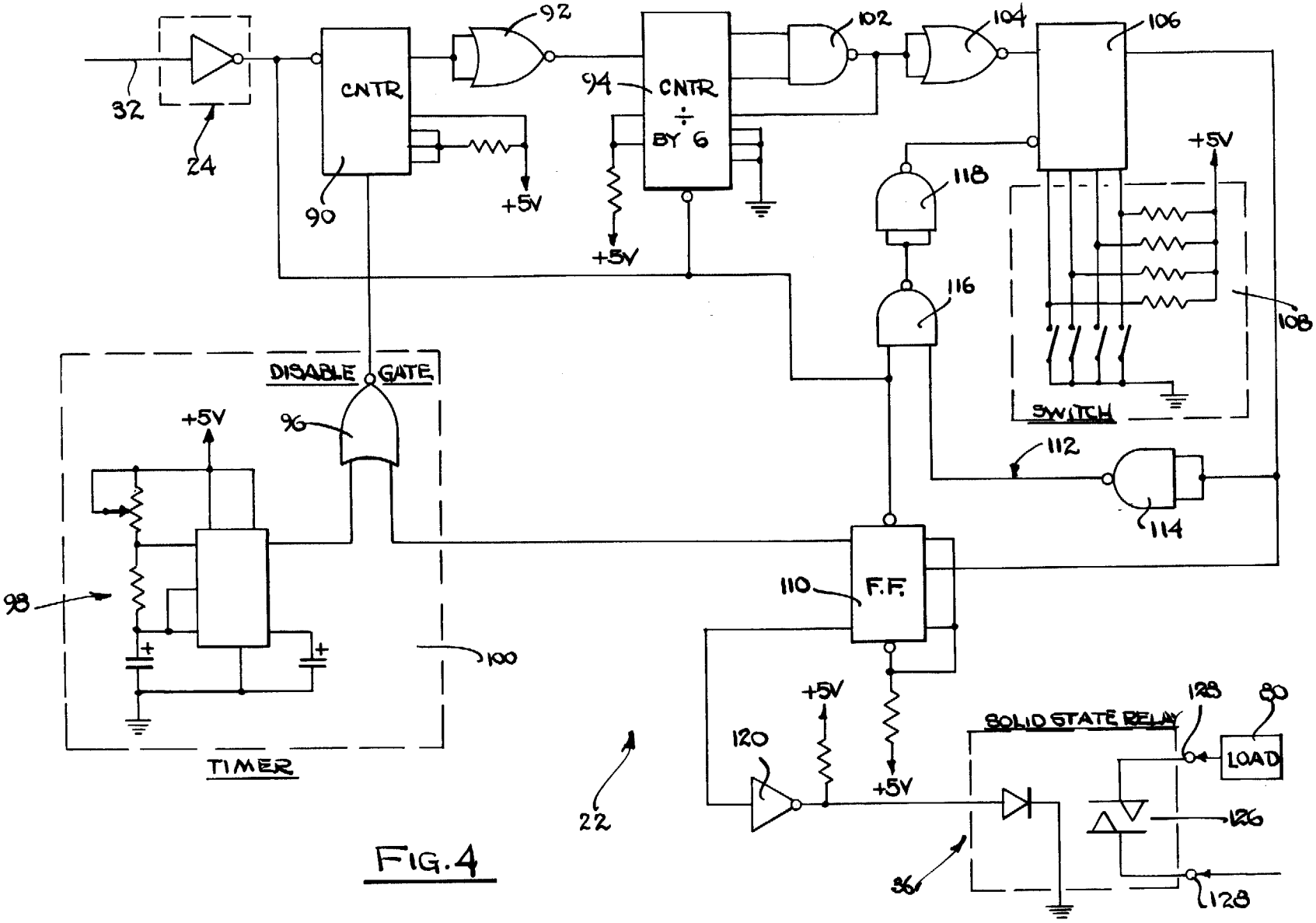

Having thus described the invention in general terms, reference will now be made to the accompanying drawings in which:

FIG. 1 is a schematic block diagram showing the overall electronic portion of the apparatus of the present invention;

FIG. 2 is a schematic circuit view of one form of analog circuit portion which may be used with the apparatus of the present invention;

FIG. 3 is a schematic circuit view of a modified form of analog circuit portion which may be used with the apparatus of the present invention;

FIG. 4 is a schematic circuit view of a digital circuit portion forming part of the apparatus of the present invention; and FIG. 5 is a schematic circuit view of a modified form of digital circuit portion which may be used with the apparatus of the present invention.

DETAILED DESCRIPTION OF PREFERRED EMBODIMENTS

Referring now in more detail and by reference characters to the drawings, which illustrate preferred embodiments of the present invention, A designates a circuit forming part of the apparatus of the present invention which automatically permits de-energization and energization of equipment operable thereby. The circuit in FIG. 1 is illustrated in a block diagram form and schematically illustrates some of the major components forming part of the circuit of the invention.

In the circuit of FIG. 1, the apparatus A comprises a transducer 10 such as a microphone, or the like, which is designed to detect sonic energy and, particularly, energy within an acoustic wavelength range. As indicated previously sonic energy, for the purpose of the present invention, will include not only sonic energy, but both subsonic energy and super-sonic energy as well.

The analog circuit portion designated by reference numeral 12, may or may not be deemed to include the transducer 10. The analog circuit portion 12 should at least include a gain amplifier, such as a gain amplifier 14 as illustrated in FIG. 1 of the drawings. In a more preferred aspect of the invention, the analog circuit portion 12 would also include a high impedence input preamplifier 16, although the latter is not absolutely necessary. Moreover, the analog circuit portion 12 preferably includes a filter, and preferably, a low pass filter 18 and a high pass filter 20. However, as indicated previously, it is of course important that the analog circuit portion should include at least the gain amplifier as such.

The apparatus of the present invention also includes the digital circuit portion 22. Further, a pulse shaper, such as a Schmitt trigger inverter 24, may also be provided. This pulse shaper functions as a discretizer and enables the analog circuit portion to be directly coupled to the digital circuit portion 22. In this respect, the discretizer 24 is often considered to be part of the analog circuit portion, although it could be considered a separate element, or otherwise, it could be considered part of the digital circuit portion 22.

The digital circuit portion 22 comprises a clock generator which is often referred to as a timer, such as an oscillator 26. The output of the oscillator 26 is introduced into a NOR gate 28 which serves to provide an input to and also receives a feedback from an internal timer 30. The feedback is generated over the feedback circuit 32, in the manner as illustrated.

The output of the internal timer 30 is introduced through a switching circuit including an inverter 34 in the digital circuit portion 22 and which in turn controls an electrical switch such as a relay 36. In this case, it can be observed that a load 38 is illustrated as being connected to a source of electrical power 40 through the electronic switch 36.

It should be observed that each of the aforesaid components forming part of both the analog circuit portion 12 and the aforesaid digital circuit portion 22 could be operated by a suitable power supply, as for example, a power supply 42 illustrated in FIG. 1 of the drawings. This power supply could be effectively an AC power source taken directly from the environment from which the apparatus is used, as for example, 120 volt AC power source. In like manner, battery power source or the like, could be provided in order to enable portability of the apparatus.

Each of the aforesaid components forming part of the apparatus A of the present invention and which are shown somewhat schematically in FIG. 1, are more fully illustrated in more detail in FIGS. 2 to 5 of the drawings.

The transducer 10 may be generally in the form of a microphone or other sound pick-up device which is connected through a capacitor 44 to the adjustable gain amplifier 14. The capacitor 44 is designed to isolate the amplifier 14 from the microphone 10, and the latter of which has one terminal thereof grounded.

A feedback circuit 48 is connected to the output and one of the inputs of the amplifier 14 and includes a resistor 50 for biasing the amplifier and establishing an open loop gain. Furthermore, an externally adjustable gain control potentiometer 52 is connected to the feedback circuit 48 to thereby enable external adjustment of the gain of the amplifier. Finally, a capacitor 54, such as a 6,000 microfarad capacitor is connected to one last mentioned input of the amplifier 14 for detecting a low frequency cutoff point of the amplifier as for example, a one thousand hertz, e.g., a one K-hertz, cutoff point. In accordance with this construction, the amplifier circuit section provides a full open loop gain.

Connected to the output of the amplifier 14 is a voltage dividing circuit 56 comprised of a pair of resistors 58 and 60 and each of which have essentially the same value. Finally, connected between the resistors 38 and 60 of the voltage dividing circuit 56 is an amplifier output line 62. The voltage dividing circuit 56 is also designed to prevent overloading of the input. In the output line 62 is a filter 65 which may be a combination of a low gain filter and a high pass filter as heretofore described.

The amplifier 14 provides an open loop gain of approximately 320,000 and is designed to have a low frequency cutoff as aforesaid at approximately 3 DB frequency of approximately 500 Hz. Further, the gain of the amplifier may be adjusted over a limited range by means of the potentiometer 52. Moreover the amplifier can be conveniently operated by a single battery operated power supply, as for example, 15 volt power supply with the amplifier output swinging over 90% of the power supply range.

FIG. 3 illustrates a modified more sophisticated type of analog circuit portion forming part of the apparatus of the present invention. In this case, the modified form of analog circuit portion is designated by reference numeral 12' and is comprised of a transducer such as a cyrstal microphone 10', similar to the previously described cyrstal microphone 10. Moreover, a capacitor 44' couples the microphone 10' into an input amplifier stage 64 comprised of a preamplifier 66 having a resistive-feedback circuit 68. A potentiometer 70 is connected to the feedback circuit 68 and is also grounded through a capacitor 72. This potentiometer 70 is designed to provide adjustable gain from about 10 to about 100. The feedback circuit 68 contains a resistor 74, which in combination with a similar resistor 76, forms a voltage dividing network. The resistor 74 and the setting of the potentiometer 70 effectively determine the gain of the amplifier. The capacitor 72 is designed to provide an AC gain with a low frequency cut off at about 100 Hz.

The output of the preamplifier 66 is connected through a coupling capacitor 78 to a low pass filter 80. The low pass filter 80 is generally of conventional construction, and therefore the various components thereof will not be described in any detail herein. However, this low pass filter 80 should preferably be one with linear phase characteristics and with a three decibel (break) frequency of 5 KHz. In one preferred aspect the cut-off slope would have a −20 decibel per decade starting at 10 KHz, thus providing attenuation above 8.5 KHz. The capacitors and resistors which form part of the low pass filter are designed in order to provide the above described filter characteristics.

The output of the low pass filter 80 is introduced into a high pass filter 82, which is also of conventional construction. The high pass filter 82 is preferably configured as a high pass eliptic filter with a three decibal cut off (break) frequency of one thousand KHz. The cut off slope is again about −20 dB per decade at a frequency of about one KHz and in this way, is capable of providing effective low frequency attenuation. Here again, the capacitors and the resistors used in the filter configuration are selected in order to determine the preferred above described filter characteristics. The combination of the low pass filter 80 and the high pass filter 82 effectively forms a band pass filter combination with a spectral bandwidth or response of about 6.5 KHz.

The output of the high pass filter is introduced into a gain amplifier, as for example the gain amplifier 14. Here again, the gain amplifier is of conventional construction and is preferably a linear amplifier with a fixed gain of about 10.94.

The gain amplifier has an output connected to discretizer 24, which in this embodiment of the invention, is being illustrated as forming part of the analog portion. As indicated previously, the discretizer 24 could be considered as part of the digital circuit portion or as an individual connecting component between the analog circuit portion and the digital circuit portion.

The discretizer 24 may adopt any known form although a Schmitt trigger inverter is preferred. The discretizer 24 effectively operates as the interface between the analog and digital portions of the circuit and is designed to provide an output of rectangularly shaped pulses between about 0 V and 10 V from the analog output of the analog portion of the circuit. Further, the discretizer is used to eliminate low level background noise within the spectral band of the circuit and this is effectively accomplished by the known action of the Schmitt trigger. Thus, only input signals above a positive going threshold level or below a negative going threshold level are capable of being introduced into the input of the digital circuit portions as hereinafter described. The discretizer 24 is also provided with an output line 32 which is capable of being introduced into the digital circuit portion.

In the preamplifier stage 64, the potentiometer 70 is arranged so that it can be externally located on the apparatus to provide a user adjustment. In this way, the user of the apparatus can adjust the potentiometer to compensate to provide a desired degree of sensitivity and thereby compensate for background noise and other ambient conditions. In this respect, a light emitting diode 84 located at the discretizer would be turned off and on with respect to the sensitivity. For example, when the potentiometer 70 is adjusted so that the light 84 just turns off, an optimum condition is achieved. In a preferred aspect of the invention, the low pass filter is designed for a cut off at about 300 Hz although it could have a low cut off point as low as a 100 Hz. The high pass filter is designed with a cut off frequency of about 7.5 KHz although it could have a high cut off frequency as much as 20 KHz or greater.

The digital circuit portion forming part of the apparatus of the present invention, in one embodiment, designated by reference numeral 22, is more fully illustrated in FIG. 4 of the drawings. This circuit portion 22 in FIG. 4 can also be referred to as a time delay and output circuit section. It can be observed that this time delay and output circuit portion 22 receives the output line 32 from the amplifier circuit portion or otherwise the output line 32' from the circuit portion 22'. The output of the low pass filter 65 is introduced into the discretizer 24 as heretofore described.

The time delay and output circuit 22 also comprises a first counter 90 and preferably a solid state counter. In addition, the output of the counter 90 is connected through an inverting NOR gate 92 to a second counter 94 the latter of which is again preferably a solid state counter. In one respect, a pair of counters e.g., the counters 90 and 94 are provided for convenience in design and implementation of the circuitry. However, it should be understood that one solid state counter could be substituted for the two counters 90 and 94.

The first of the counters 90 receives an input through a NOR gate 96 from a solid state timer 98. Inasmuch as the timer itself is of conventional construction, it is neither illustrated nor described in any detail herein. However, in any case the NOR gate 96 can be considered as forming part of the timer to constitute a timer circuit 100. The gate 96 serves as a disable gate in order to disable the counters as hereinafter described in more detail.

The output of the second of the timers 94 is connected to a NAND gate 102 which serves as a decoder and allows the timer 94 to function as a divide by six counter. The output of the decoder gate 102 is connected through another Nor gate 104 to a third timer 106, which is preferably a solid state counter and connected to the timer 106 is a manually operable solid state, programable timing switch 108. In this case, the timing switch 108 is a BCD switch, although it could be a manually operable thumbwheel switch or the like. Hence, as a BCD switch it has a plurality of set positions thereupon. Nevertheless, the switch 108 is connected to the timer 106 in order to permit external control over a predetermined time period which may be manually introduced. In this way, the user of the apparatus has some degree of control over the amount of predetermined time which is required before the circuit initiates a warning signal or otherwise cuts off any electrically operable equipment in response to activity over a threshold level in a certain environment.

An output of the counter 106 is connected to a flip-flop 110 and also to part of a feedback circuit 112. Included within the feedback circuit 112 is a NAND gate 114, in the manner as illustrated in FIG. 4. The NAND gate 114 effectively serves as an inverter or inverting gate. This inverting gate 114 is in turn, connected to another NAND gate 116 and also an inverting gate 118. In this respect, it can be observed that the gate 116 receives an input from the flip-flop 116 and also from the output of the amplifier 38. Finally, the output of the gate 118 is introduced back into the third counter 106 in order to complete the feedback path. It can also be observed that the flip-flop 110 has one input to the NOR gate 96.

The output of the flip-flop 110 is connected through an inverting buffer amplifier 120 to a relay e.g., the electrical switching relay 36. This relay 36 is preferably a solid state relay, in the manner as illustrated in FIG. 4. The solid state relay is effectively operable by means of an optically isolated triac 126. Moreover, it can be observed that the solid state relay 36 is provided with output terminals 128 for connection to a suitable load, such as the load 38, in the manner to be hereinafter described.

The load 38 as indicated above may adopt any electrically operable device or equipment. For example, the load 38 could constitute lights, air-conditioning equipment or for that matter, a simple electrically operable switch. One of the important aspects of the present invention is that when the circuit detects sound over a certain level within a specified environment during or after a predetermined time period, it generates a signal which is effectively a disenable signal, since it disenables electrically operable equipment.

The discretizer 24 effectively operates to clear the first and second counters 90 and 94, respectively, and to reset the third counter 96 and the flip-flop 110 as well as to energize the solid state relay 36. The decoder 102 allows timer 94 to be a divide by six counter as indicated above. This decoder is capable of detecting for example, six counts and then shifts to a zero level. When the counter 106 reaches a maximum count, its output will shift to a zero level and thereby turns on the flip-flop 110 which, in turn, energizes the solid state relay 36 thereby effectively permitting the creation of a disenable signal. This signal is effectively a disenable signal since the third counter 106 generates a signal which disables the clock through Nor gate 96, as well. In essence, the disenable signal is one which turns off the relay to discontinue power to the load.

As indicated previously, the flip-flop 110 turns on the solid state relay 36 and thereby functions as a latch. It is reset as soon as the noise is detected as being above the threshold level. Thus, the flip-flop 110 remains reset until the predetermined time period set through the manually operable solid state time delay mechanism 58 has expired.

The first and second counters 90 and 94, along with the decoder gate 102, and the third counter 106 form an adjustable time delay circuit. The basic time-base is supplied by the timer 98 which is an integrated circuit, as aforesaid and is designed to provide an acurate square wave with a period of one second. The first counter 90 is wired as a decade counter and the second counter 94 is designed to provide a modulo-six count. As indicated previously, the count of the third counter, 106 is set by the programable switch 108 which allows for the programable time delay and which may range from about one minute to about fifteen minutes incrementing in one minute steps. The output of the JK flip-flop 110 is set by the timing circuit which receives the output from the third counter 106.

As indicated, the setting of the flip-flop 110 disables the output from the timer 98, thus preventing the timer circuit from counting any further. Secondly, the output of the JK flip-flop 110, when set, enables the output of the solid state relay 36 through the inverting buffer.

The entire system may be reset from the output of the discretizer 24, Whenever a signal which is above the Schmitt trigger threshold is received from the amplifier, all of the counters and the flip-flop 110 are reset to zero, thereby restarting the time delay. This action will also energize the solid state relay 36. The solid state relay 36 will only be in the "on" condition as long as noise levels from the amplifier are above the Schmitt trigger thresholds. During period of inactivity, and depending upon which time period has been selected, the timing circuitry will time-out, thereby setting the output of the flip-flop 110 and turning off the solid state relay 36.

In other words, the circuit will energize the solid state relay, e.g., turn the same on, when the noise level in a given environment is above the preset threshold noise level and in a given spectral band. The solid state relay is turned off if no noise is detected during the preset time period in this environment, as for example, in the range of one to fifteen minutes.

FIG. 5 illustrates another modified form of digital circuit portion of the present invention, which also functions as a time delay and output circuit. This embodiment of the digital circuit portion is designated by reference numeral 22. In this case, the time delay and output circuit 22 receives an input from the output line from the discretizer 24 and which is introduced into a NOR gate 134, the latter of which also receives an input from a counter 136. Further, the counter 136 is designed to replace the two previous counters 90 and 94 in the circuit of FIG. 4. Moreover, the output of the inverted NOR gate 134 is directed to a second counter 138 and the latter, of which, functions in a manner similar to the counter 96. The counter 138 also functions as a timer and is provided with a timing switch 140 connected thereto.

Again the timing switch 140 is a BCD switch very similar to the BCD timing switch 108 connected to the counter 106. However, again, a manually operable thumbwheel switch, or the like, could be employed. In addition, the timing switch 140 enables the user of the apparatus to set the predetermined time interval which must lapse before the circuit initiates a signal to de-energize electrically operable equipment.

The circuit 22 also employs a timer circuit 142 which is similar to the previously described timer circuit 100. In this case, the timer circuit 142 includes a solid state timing chip 144 provided with a resistive-capacitive network as illustrated. Moreover, the output of the timing circuit 142 is directed to a NOR gate 146 which receives an input from a switching circuit 148 in the manner as illustrated in FIG. 5. Again, the output of the NOR gate 146 is introduced, as an input, into the first counter 136, in the manner as illustrated. In this respect, the construction of the timing circuit 142 and the NOR gate 146 is similar to that of the counter 90 and the NOR gate 92 in the circuit of FIG. 4 of the drawings. It should also be understood that the NOR gate 146 could be considered to be part of the timer circuit 142.

The timer 142, and particularly the circuit chip 144 forming a part thereof, is wired or configured as an astable multivibrator with a rectangular output wave form, preferably between 0 and 10 volts and with a time period of about 6 seconds. The frequency of the timer is determined by a pair of resistors 149 and 150 in a voltage dividing network along with a capacitor 151. The output of the timer 142 through the NOR gate 146 is a compliment of the actual output of the timer 142 if the other input into the NOR gate were a low or logic zero level.

The output of the timer circuit 142 is introduced into the counter 136 which again is configured to operate as a divide-by-ten counter and preferably an up-counter. In this way, the counter 146 will produce an output after 10 counts (approximately 60 seconds) thereby causing the counter 138 to increment by one. The counter 138 is preferably a divide-by-sixteen counter and again preferably an up-counter. Certain inputs to the counter 138 are programable inputs from the timing switch 140, e.g., the four inputs from the timing switch 140. Consequently, these inputs can be adjusted to provide a time interval of about 1 to 15 minutes in units of one minute increments. It should be understood in connection with the present invention, that any time interval could be provided and even one substantially greater than 15 minutes could be provided.

The counter 138 actually begins a count with a number programmed by the switches 140 and always ends with the count of 15 or whatever is elected and preprogrammed as the highest number of a count.

The switching circuit 148 effectively operates as an output switching circuit and receives an output from the main timer 138 through an inverting NOR gate 150. Moreover, the output switching circuit 148 is comprised of a pair of JK flip-flops 152 and 154, in the manner as illustrated in FIG. 5. These flip-flops 152 and 154 each operate so as to provide electrical signals to one or more amplifiers, e.g., amplifiers 156 and 158 and which are, in turn, connected to relays (not shown). In other words, when the flip-flops 152 and 154 contained within the output circuit 148 are shifted to the set state, they will provide an electrical output signal which is amplified by the amplifiers 156 and 158 and this signal is a signal to cause the electrically operable equipment to be de-energized.

A capacitor 160 is connected across the output of the NOR gate 134 and the input to the flip-flop 154. This capacitor 160 is also grounded in the manner as illustrated in FIG. 5. The capacitor 160 is effectively designed to operate as a pulse stretcher and functions in the manner of a low pass filter. This capacitor 160 is desirable inasmuch as the pulse itself is narrow, and the pulse stretcher prevents a narrow pulse from inadvertently triggering the apparatus, such that the capacitor, making the apparatus more reliable.

When the counter 138 begins a count and ends with the count of 15, or whatever number is introduced as the highest number of count, a signal is transmitted to the JK flip-flop 152 in the output circuit 48 through a NOR gate inverter 150 which causes the JK flip-flop 154 to immediately set. A low level signal from the analog circuit portion immediately resets the counter 136 as well as each of the flip-flops 152 and 154. This same signal also presets the counter 138 in accordance with the binary code introduced by the manually operable switches 140.

The flip-flop 154 serves a dual function in that it sets the flip-flop 152 and also acts as a 1-count delay during the timing period, that is the period before the counter 138 is reset and the flip-flop 152 is set. The action which takes place in a temporal relationship occurs as follows. As the flip-flop 154 is set, its normal output goes high while its complimentary output goes low. That is, the positive going output pulse as illustrated goes high and the lower or negative going output pulse goes low. The positive going pulse causes the output of the NOR gate 150 to go low which preloads the counter 138 and also clears the flip-flop 154. The flip-flop 152, which may have already previously cleared, remains uneffected by this operation. Upon clearing the flip-flop 154, the lower or inverted pulse goes high which thereby sets the flip-flop 152. When the flip-flop 152 is set, its Q or positive output, that is the upper output, goes high which disenables the clock input from the counter 142 to the counter 136. Accordingly, any further counting is inhibited.

In accordance with the above outlined conditions, a steady state condition then results with the count or both of the counters 136 and 138 being inhibited. The flip-flop 154 is set and the output of the flip-flop 152 is connected directly to the relay 156 and 158 as they are de-energized. This condition will remain until a high level signal is received from the amplifier which will clear the counter 136, thereby preloading the counter 138. This will also clear both of the flip-flops and enable the clocking pulses from the timer 142 to further energize each of the relays.

The circuit of FIG. 5 operates very similar to the circuit of FIG. 4, except that it eliminates a few of the components and in particular, utilizes only two counters in place of the three counters provided in FIG. 2. The setting of the flip-flops 152 and 154 effectively disables the timing circuit from counting any further. The relays will always be in the on condition as long as noise levels from the amplifier are above the Schmitt trigger threshold level. During periods of inactivity and depending upon the time which has been selected as set in the timing control switch 140, the timing circuitry will time-out, thereby setting the output of the flip-flops 152 and 154 and turning off the relay amplifiers 156 and 158. In other words, the circuit will energize relay amplifiers 156 and 158 and turn the same on when the noise level in a given environment and in a given spectral band exceeds the preset and predetermined time delay. Again, the relays will be turned off when no noise is detected in the preset time period in this specified environment.

It can be observed in accordance with the above that there is a wide range of applications which are suitable for the system of the present invention. Some of these applications are summarized in exemplary, but non-limiting sense. For example, the system of the present invention can be used as a wall mounted switch to control lights, air conditioning, heating, or other electrically operable equipment in a specified environment. In another example of the present invention, the system as described herein can be employed as a semi-intelligent controller for regulating the use of various electrically operable equipment. As a further embodiment of the invention, the system of the present invention may be operable as an alarm device to indicate the presence of individuals in a given specified environment and particularly for detection of unauthorized entry. It should also be understood that the system of the invention is effective for use in street and other outdoor environments and therefore not necessary limited for use in internal or household environmental use.

Thus, there has been illustrated and described a unique and novel apparatus and method for automatically de-energizing electrically operable equipment in response to a lack of animal activity for a predetermined period, and which therefore fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by Letters Patent is:

1. An energy conservation apparatus capable of deactivating an energy operable device after a predetermined time interval when no human activity is detected in a specified environment during the predetermined time interval, said apparatus comprising:

(a) passive sensing means for sensing physical activity of the type normally associated with the presence of a human being in a specified environment and thereby recognizing a lack of such activity during a predetermined time interval without generating or relying upon a standing wave for such sensing, and which does not rely upon generation of any signal by said apparatus to be introduced into said specified environment and which signal must be detected or interrupted in the specified environment for operation, (b) signal generating means operatively associated with said sensing means and being able to generate a signal upon the sensing of the physical activity in the predetermined time interval and thereby also recognizing a lack of the activity in the predetermined time interval, (c) time delay means for establishing a predetermined time interval which is used for determining presence of or lack of human activity during such interval, (d) logic circuit means operatively connected to said signal generating means and time delay means, said logic circuit means being operable to effectuate:

(1) connection of the energy operable device to a source of power if human activity was detected in the specified environment during the predetermined time interval, (2) disconnection of the energy operable device from the source of power if no activity of the type associated with human presence was detected in the specified environment during the predetermined time interval, (3) re-connection of the energy operable device to the source of power if activity of the type associated with human presence is again detected in the specified environment and to maintain that re-connection for at least the predetermined time interval, regardless of the time period between re-connection, and (e) output circuit means opertively connected to said logic circuit means and capable of being coupled to an energy operable device under control of said logic circuit means to de-energize the energy operable device if the human physical activity did not occur in the specified environment for at least the predetermined time interval, and to maintain energization of the energy operable device if human physical activity occurred during the predetermined time interval or re-energizing such device if human physical activity re-occurs after the predetermined time interval.

2. The energy conservation apparatus of claim 1 further characterized in that said passive sensing means senses an energy level in a specified wavelength and the signal generating means generates a signal in response to the sensed energy level in the specified wavelength.

3. The energy conservation apparatus of claim 2 further characterized in that the specified wavelength comprises energy in the sonic wavelength range.

4. The energy conservation apparatus of claim 3 further characterized in that the energy operable device is an electrically operable device such that the output circuit means electrically de-energizes the electrically operable device if no physical activity occurred in the specified environment for at least the predetermined time interval, and the output circuit means maintains electrical energization of the device if human physical activity occurred during the predetermined time interval or electrically re-energizes such device if human physical activity re-occurs after the predetermined time interval.

5. The energy conservation apparatus of claim 4 further characterized that the output circuit means comprises a relay means coupled to the electrically operable device and controls the electrical power delivered to the electrically operable device in response to the occurrence of the physical activity.

6. The energy conservation apparatus of claim 2 further characterized in that the time delay means is an adjustable time delay means.

7. The energy conservation apparatus of claim 6 further characterized that said time delay means is a user manually adjustable time delay means.

8. The energy conservation apparatus of claim 6 further characterized that said apparatus comprises sensitivity control means to adjust the sensing means to account for a background noise level.

9. An electronically operable apparatus for detecting the presence of animal activity in a specified environment and providing responsive action upon detection of animal activity within a predetermined time interval, said apparatus comprising:

(a) passive sensing means for sensing an energy level in a particular wavelength range resulting from activity in a specified environment and which does not generate a standing wave or other signal for introduction into the specified environment and which signal must be detected or interfered with in the specified environment for operation.

(b) clocking circuit means to provide a predetermined time interval to enable a determination of whether an activity occurred in said predetermined time interval in said specified environment, (c) first counter means operatively connected to said clocking circuit means to initiate a counting operation upon detection of an animal activity in said predetermined time interval in said specified environment, (d) second counter means operatively connected to said first counter means to reset a counting operation in response to a lack of animal activity in said predetermined time interval, (e) manually adjustable time delay control means operatively connected to said second counter means to adjust the predetermined time interval, and (f) output means operatively connected to at least one of said counter means and being adapted for connection to an electrically operable device, said output means controlling the power delivered to said device and permitting delivery of electrical power to said device upon detection of animal activity within the predetermined time interval, said output means also preventing delivery of electrical power to said device while there is a lack of activity in the specified environment after said predetermined time interval.

10. The electronically operable apparatus of claim 9 further characterized in that said apparatus comprises amplifier means for receiving a signal representing the presence of animal activity in an enclosed environment and amplifying same and which amplifier means is connected to said means for sensing.

11. The electronically operable apparatus of claim 9 further characterized in that said first counter means provides an electrical signal with a specified count period and the second of the counter means is configured to count to a certain modulo number.

12. The electronically operable apparatus of claim 11 further characterized in that said first counter means provides a rectangular wave with a period of about one second and the second counter is configured to count to a modulo six.

13. The electronically operable apparatus of claim 10 further characterized in that said apparatus comprises a Schmitt trigger means for resetting the second counter means.

14. The electronically operable apparatus of claim 9 further characterized in that said manually adjustable time control means is a solid state time adjusting mechanism having a plurality of fixed time control positions.

15. The electronically operable apparatus of claim 9 further characterized in that the particular wavelength range comprises energy in the acoustic spectrum.

16. The electronically operable apparatus of claim 9 further characterized in that the output means comprises a relay means coupled to an electrically operable device.

17. The electronically operable apparatus of claim 15 further characterized in that the said apparatus comprises sensitivity control means operatively connected to said sensing means to adjust for background noise level.

18. An energy conservation apparatus capable of deactivating an electrically operable device after a predetermined time interval when no animal presence is detected in a specified environment during the predetermined time interval, said apparatus comprising:

(a) sensing means for detecting sound resulting from human created physical activity in a specified environment and for enabling a determination of a lack of such physical activity in said specified environment after a predetermined interval, said sensing means being operable without generating or relying upon generation of a standing wave or other signal by said apparatus which is provided for introduction into the specified environment and which must be detected or interrupted in the specified environment, (b) signal generating means operatively associated with said sensing means and being able to generate a signal upon the sensing of the sound resulting from physical activity in the predetermined time interval and thereby also recognizing a lack of such activity in the predetermined time interval, (c) time delay means operatively connected to said signal generating means to establish a predetermined time interval and to permit control over the predetermined time interval, (d) amplifier means operatively connected to said signal generating means for amplifying the signal so generated, (e) sensitivity control means operatively connected to said amplifier means to adjust and control the sensitivity of the apparatus to account for background noise, (f) logic circuit means operatively connected to said time delay means and being operable to effectuate:

(1) connection of the electrically operable device to a source of electrical power if physical activity was detected in the specified environment during the predetermined time interval, (2) disconnection of the electrically operable device from the source of power if no physical activity of the type associated with animal presence was detected in the specified environment during the predetermined time interval, (3) re-connection of the electrically operable device to the source of power if activity of the type associated with animal presence is again detected in the specified environment and to maintain that re-connection for at least the predetermined time interval, regardless of the time period between re-connection, and (g) output circuit means operatively connected to said time delay means and logic circuit means and capable of being coupled to an electrically operable device, said output circuit means being operable by at least said logic circuit means to de-energize the electrically operable device when said apparatus detected that physical activity did not occur in the specified environment for at least the predetermined time interval, said output circuit means being operable to maintain energization of the electrically operable device if physical activity occurred during the predetermined time interval, said output circuit means also being operable by said logic circuit means to re-energize the electrically operable device again upon re-occurrence of physical activity in the specified environment.

19. The energy conservation apparatus of claim 18 further characterized in that the said time delay means is a user adjustable time delay means.

20. The energy conservation apparatus of claim 19 further characterized in that the said sensitivity control means in a user adjustable sensitivity control means.

21. The energy conservation apparatus of claim 20 further characterized in that said sensitivity control means controls the gain of the amplifier means to adjust for background noise.

22. Circuit active means for detecting the presence of animal activity in an enclosed environment in response to an activity creating an electrical signal within a certain wavelength range, and thereby recognizing a lack of animal activity in the enclosed environment thereafter, said circuit active means comprising:

(a) filter means to receive the electrical signal and filter out undesirable signal portions, (b) amplifier means for receiving the filtered signal representing the presence of animal activity in an enclosed environment and amplifying same, and which signal representing animal activity is generated without reliance upon a standing wave for sensing or other signal generated by said apparatus for introduction in the specified environment and interfered with in the specified environment to create the signal representing the presence of animal activity, (c) discretizing means receiving the amplified signal and converting same to digital equivalent signals for further processing and providing pulses of a desired shape, (d) first counter means receiving the digital signals from the discretizing means and generating a time count based on the existance of said digital signals, (e) second counter means coupled to said first counter means and determining whether said time count reaches a minimum predetermined time interval, (f) manually adjustable time control means operatively connected to said second counter means to adjust the predetermined time interval, (g) a time generating circuit operatively connected to said first counter means, (h) a feedback circuit operatively connected between said first counter means and second counter means and receiving a time control input from said time generating circuit and (i) output circuit means operatively connected to at least said time control means or time generating means and providing a first responsive action to the presence of animal activity and a second responsive action to a lack of animal activity in the enclosed environment for at least the predetermined time interval.

23. The circuit active means of claim 22 further characterized in that said amplifier means comprises a gain adjustable amplifier.

24. The circuit active means of claim 23 further characterized in that the amplifier has a defined spectrum bandwith.

25. The circuit active means of claim 22 further characterized in that said first counter means provides an electrical signal with a specified count period and the second of the counter means is configured to count to a certain modulo number.

26. The circuit active means of claim 25 further characterized in that said first counter means provides a rectangular wave with a period of about one second and the second counter is configured to count to a modulo six.

27. The circuit active means of claim 26 further characterized in that said circuit active means comprises a Schmitt trigger means for resetting the circuit active means.

28. The circuit active means of claim 26 further characterized in that said output circuit means is adapted for operative connection to an energy operable device and de-energizes said device if animal activity has not occurred in the enclosed environment in the predetermined time interval.

29. The circuit active means of claim 28 further characterized in that the energy operable device is an electrically operable device such that the output circuit of the circuit active means electrically de-energizes the electrically operable device if the activity did not occur in the enclosed environment for at least the minimum predetermined time interval.

30. The circuit active means of claim 29 further characterized in that the output circuit means comprises a relay means coupled to the electrically operable device and controls the electrical power delivered to the electrically operable device in response to the occurance of the physical activity.

31. A method of energy conservation by deactivating an energy operable device where no sound from animal presence is detected in a specified environment during a predetermined time interval, said method comprising:

(a) passively monitoring for presence of sound in a specified environment at a level normally created by human activity and without generating or relying upon a standing wave for such sensing and which also does not rely upon generation of any signal to be introduced into the specified environment for purposes of detection or interruption in the specified environment to enable a sensing, (b) generating an electrical signal upon the sensing of the sound of the type created by human physical activity in the specified environment, (c) setting a sensitivity control to account for background noise, (d) setting a minimum predetermined time interval such that a lack of sound of the type created by human physical activity in the specified environment during the predetermined time interval permits deactivation of an energy operable device, and sound of the type resulting from a presence of human physical activity in the specified environment during the predetermined time interval will prevent deactivation of said energy operable device, (e) determining if the sound did not occur for at least the manually set predetermined time interval in the specified environment, (f) automatically de-energizing the energy operable device if the sound did not occur in the specified environment for at least the predetermined time interval, (g) resetting and restarting the minimum predetermined time interval upon detection of each new sound above a level established by the sensitivity control, and (h) thereafter reactivating the energy operable device if sound is again detected in the specified environment after the predetermined time interval.

32. The method of claim 31 further characterized in that said method comprises filtering the signal for selecting and using a portion of the signal representative of sound of the type resulting from presence of human activity.

33. The method of claim 32 further characterized in that said method comprises amplifying the electrical signal.

34. The method of claim 32 further characterized in that the energy operable device is an electrically operable device such that the method comprises electrically de-energizing the electrically operable device if no sound was detected in the specified environment for at least the predetermined time interval.

35. An electronically operable aparatus for detecting the presence of animal activity in a specified environment and providing responsive action upon detection of animal activity, said apparatus comprising:

(a) passive sensing means for sensing an energy level in an acoustic wavelength range resulting from activity in a specified environment and which does not generate a standing wave for sensing, (b) clocking circuit means to provide a predetermined time interval to enable a determination of whether an activity occurred in said predetermined time interval in said specified environment, (c) first counter means operatively connected to said clocking circuit means to initiate a counting operation upon detection of an animal activity in said predetermined time interval in said specified environment, (d) second counter means operatively connected to said first counter means to disable a counting operation in response to a cessation of animal activity in said predetermined time interval, (e) manually adjustable time delay control means operatively connected to said second counter means to adjust the predetermined time interval, and (f) output circuit means operatively connected to at least one of said counter means to control the electrical power delivered to an electrically operable device in response to the occurance of and detection of animal physical activity within the predetermined time interval, said output circuit means comprising a relay means coupled to said electrically operable device, said apparatus thereby effectively recognizing a lack of animal physical activity after cessation thereof in the specified environment and after said predetermined time interval.

36. An electronically operable apparatus for detecting the presence of animal activity in a specified environment and providing responsive action upon detection of such activity, said apparatus comprising:

(a) passive sensing means for sensing an energy level in an acoustic wavelength range resulting from activity in a specified environment and which does not generate a standing wave for sensing, (b) clocking circuit means to provide a predetermined time interval to enable a determination of whether an activity occurred in said predetermined time interval in said specified environment, (c) counter means operatively connected to said clocking circuit means to initiate a counting operation upon detection of an animal activity in said predetermined time interval in said specified environment, said counter means being adapted to disable and cease a counting operation after said predetermined time interval if no animal activity occurred during the predetermined time interval, said counter means also being adapted to initialize a counting operation to restart the predetermined time interval upon detection of each new physical activity, (d) time delay control means operatively connected to said counter means to adjust the predetermined time interval, and (e) output circuit means operatively connected to said counter means and having means for coupling to an electrically operable device to control the electrical power delivered to an electrically operable device in response to the occurances and detection of animal physical activity within the predetermined time interval, such that the electrically operable device is de-energized if no animal physical activity occured during the predetermined time interval and energization of such device is maintained if physical activity occurred during the time interval and such device is re-energized upon detection of new animal physical activity after the predetermined time interval.

37. An electronically operable apparatus for detecting the presence of sound in a specified environment and providing responsive action upon the detection of sound, said apparatus comprising:

(a) passive sensing means for sensing a sound level in an audible wavelength range resulting from activity in a specified environment and which sensing means does not generate a standing wave for sensing, (b) clocking circuit means to provide a predetermined time interval to enable a determination of whether a sound occurred in said predetermined time interval in said specified environment, (c) counter means operatively connected to said clocking circuit means to initiate a counting operation upon detection of a sound in said predetermined time interval in said specified environment, said counter means being adapted to disable and cease a counting operation after said predetermined time interval if no sound occurs during the predetermined time interval, said counter means also being adapted to initialize a counting operation to restart the predetermined time interval upon detection of each new sound, (d) time delay control means operatively connected to said counter means to adjust the predetermined time interval, and (e) output circuit means operatively connected to said counter means and having means for coupling to an electrically operable device to control the electrical power delivered to an electrically operable device in response to the occurrance of sound within user predetermined time interval, such that the electrically operable device is de-energized if no sound was detected during the predetermined time interval and energization of such device is maintained if sound occurred during the predetermined time interval and such device is re-energized upon detection of new sound after the predetermined time interval.

38. An energy conservation apparatus capable of deactivating an energy operable device after a predetermined time interval when no sound of the type associated with human presence is detected in a specified environment during the predetermined time interval, said apparatus comprising:

(a) passive sensing means for sensing presence of sound of a type normally associated with human activity in a specified environment and during a predetermined time interval without generating or relying upon a standing wave for such sensing, (b) signal generating means operatively associated with said sensing means for generating a signal upon the detection of sound in the specified environment, (c) sensitivity control means operatively connected to said signal generating means to adjust and control the sensitivity of the apparatus to account for background noise.

(d) clocking circuit means to provide a predetermined time interval to enable a determination of whether a sound occurred in said predetermined time interval in said specified environment, (e) counter means operatively connected to said clocking circuit means to initiate a counting operation upon detection of a sound in said predetermined time interval in said specified environment, said counter means being adapted to disable and cease a counting operation after said predetermined time interval if no sound occurs during the predetermined time interval, said counter means also being adapted to initialize a counting operation to restart the predetermined time interval upon detection of each new sound, (f) logic means operatively connected to said counter means to determine if there was no sound for at least the predetermined time interval, and (g) output circuit means operatively connected to said logic means and having means capable of being coupled to an energy operable device to de-energize the energy operable device if sound did not occur in the specified environment for at least during the predetermined time interval, and to maintain energization of the energy operable device if sound occurred during the predetermined time interval or re-energizing such device if sound re-occurs after the predetermined time interval.

39. The apparatus of claim 38 further characterized in that said apparatus comprises user manually adjustable time delay control means operatively connected to said counter means or clocking circuit means to adjust the predetermined time interval.

40. An energy conservation apparatus capable of deactivating an energy operable device after a predetermined time interval when no sound of the type associated with human presence is detected in a specified environment during the predetermined time interval, said apparatus comprising:

(a) passive sensing means for sensing presence of sound of a type normally associated with human activity in a specified environment and during a predetermined time interval without generating or relying upon a standing wave for such sensing, (b) signal generating means operatively associated with said sensing means for generating a signal upon the detection of such sound in the specified environment, (c) amplifier means for amplifying the generated signal, (d) sensitivity control means for establishing a minimum threshold level for the sensed and amplified signal so that the resultant portion of the signal which exceeds said threshold level may be more representative of sound of the type which may be created by the presence of human activity in the specified environment during such predetermined time interval, (e) clocking circuit means to provide a predetermined time interval to enable a determination of whether a sound exceeding the threshold level occurred in said predetermined time interval in said specified environment, (f) counter means operatively connected to said clocking circuit means to initiate a counting operation upon detection of a sound exceeding the threshold level in said predetermined time interval in said specified environment, said counter means being adapted to disable and cease a counting operation after said predetermined time interval if no sound exceeding the threshold level occurs during the predetermined time interval, said counter means also being adapted to initialize a counting operation to restart the predetermined time interval upon detection of each new sound, (g) logic means operatively connected to said counter means to determine if there was no sound exceeding the threshold level for at least the predetermined time interval, and (h) output circuit means operatively connected to said logic means and having means capable of being coupled to an energy operable device to de-energize the energy operable device if sound exceeding the threshold level did not occur in the specified environment for at least during the predetermined time interval, and to maintain energization of the energy operable device if sound exceeding the threshold level occurred during the predetermined time interval or re-energizing such device if sound exceeding the threshold level re-occurs after the predetermined time interval.

41. The apparatus of claim 40 further characterized in that said sensivity control means is a manually adjustable control means.

42. The apparatus of claim 41 further characterized in that a manually adjustable time control means is operatively associated with said clocking circuit means to adjust the predetermined time interval.

43. Circuit active means for detecting the presence of human activity in an enclosed environment in response to an activity creating an electrical signal within a certain wavelength range, and thereby recognizing a lack of human activity in the enclosed environment thereafter, said circuit active means comprising:

(a) amplifier means for receiving the signal representing the presence of human activity in an enclosed environment and amplifying same, and which signal representing human activity is generated without reliance upon a standing wave for sensing or other signal generated by said apparatus for introduction in the specified environment and interferred with in the specified environment, such that the signal representing the presence of human activity is created by the presence of the animal activity, (b) sensitivity control means operatively connected to said amplifier means for adjusting the gain of the amplifier means and hence the sensitivity of the circuit active means, (c) converting means receiving the amplified signal and converting same to equivalent digital signals for further processing and providing pulses of a desired shape, (d) time generating circuit means for generating a timing signal used to establish a predetermined time interval, (e) counter means receiving the timing signal from the time generating circuit and the digital signals from the converting means and generating a time count based on said digital signals and determining whether said time count has extended for the duration of the predetermined time interval, (f) time control means operatively connected to said counter means to adjust the predetermined time interval, (g) a feedback circuit operatively connected with respect to said counter means and receiving a time control input from said time generating circuit means, (h) logic circuit means operatively associated with said counter means and providing an energize control signal in response to detection of human activity in said environment for said predetermined time interval and providing no energize control signal upon recognition of no activity for said predetermined time interval, and (i) output circuit means operatively connected to said logic circuit means and providing a first responsive action to the presence of human activity and a second responsive action to a lack of human activity in the enclosed environment for at least the predetermined time interval.

44. The circuit active means of claim 43 further characterized in that said amplifier means comprises a gain adjustable amplifier.

45. The circuit active means of claim 44 further characterized in that the amplifier has a defined spectrum bandwith.

46. The circuit active means of claim 43 further characterized in that said counter means comprises a first counter means which provides an electrical signal with a specified count period and a second counter means which is configured to count to a certain modulo number, and said second counter means being connected to said first counter means.

47. The circuit active means of claim 44 further characterized in that a filter means is operatively connected to amplifier means.

48. The circuit active means of claim 47 further characterized in that said circuit active means comprises a Schmitt trigger means for resetting the circuit active means.

49. The circuit active means of claim 43 further characterized in that said output circuit means is adapted for operative connection to an energy operable device and de-energizes said device if human activity has not occurred in the enclosed environment in the predetermined time interval.

50. The circuit active means of claim 49 further characterized in that the energy operable device is an electrically operable device such that the output circuit means electrically de-energizes the electrically operable device if the human activity did not occur in the enclosed environment for at least the minimum predetermined time interval.

51. The circuit active means of claim 50 further characterized in that the output circuit means comprises a relay means coupled to the electrically operable device and controls the electrical power delivered to the electrically operable device in response to the occurance of the physical activity.

52. An electrically operable apparatus for detecting the presence of sound in a specified environment and providing responsive action upon the detection of sound, said apparatus comprising:

(a) passive sensing means for sensing a sound level in an audible wavelength range resulting from activity in a specified environment and which sensing means does not generate a standing wave for sensing, (b) clocking circuit means to provide a predetermined time interval to enable a determination of whether a sound occurred in said predetermined time interval in said specified environment, (c) counter means operatively connected to said clocking circuit means to initiate a counting operation upon detection of a sound in said predetermined time interval in said specified environment, said counter means being adapted to disable and cease a counting operation after said predetermined time interval if no sound occurs during the predetermined time interval, said counter means also being adapted to initialize a counting operation to restart the predetermined time interval upon detection of each new sound, (d) time delay control means operatively connected to said counter means to adjust the predetermined time interval, and (e) output circuit means operatively connected to said counter means and having means for coupling to an electrically operable device to control the electrical power delivered to an electrically operable device in response to the absence of sound within user predetermined time interval, such that the electrically operable device is de-energized if sound is detected during the predetermined time interval and such device is re-energized upon no detection of sound after the predetermined time interval.

53. A method of energy conservation by deactivating an energy operable device where sound from animal presence is detected in a specified environment during a predetermined time interval, said method comprising:

(a) passively monitoring for presence of sound in specified environment at a level normally created by human activity and without generating or relying upon a standing wave for such sensing and which does not rely upon generation of any signal to be introduced into the specified environment for purposes of detection or interruption in the specified environment to enable a sensing, (b) generating an electrical signal upon the sensing of the sound of the type created by human physical activity in the specified environment, (c) setting a sensitivity control to account for background noise, (d) setting a minimum predetermined time interval such that sound of the type created by human physical activity in the specified environment during the predetermined time interval permits deactivation of an energy operable device and sound of the type resulting from a presence of human physical activity in the specified environment during the predetermined time interval will prevent activation of said energy operable device, (e) determining if the sound did occur for at least the manually set predetermined time interval in the specified environment, (f) automatically energizing the energy operable device if the sound did not occur in the specified environment for at least the predetermined time interval, (g) resetting and restarting the minimum predetermined time interval upon detection of each new sound above a level established by the sensitivity control, and (h) thereafter deactivating the energy operable device if sound is again detected in the specified environment after the predetermined time interval.

54. An electrically operable apparatus for detecting the presence of sound in a specified environment and providing responsive action upon the detection of sound, said apparatus comprising:

(a) passive sensing means for sensing a sound level in an audible wavelength range resulting from activity in a specified environment and which sensing means does not generate a standing wave for sensing, (b) clocking circuit means to provide a predetermined time interval to enable a determination of whether a sound occurred in said predetermined time interval in said specified environment, (c) counter means operatively connected to said clocking circuit means to initiate a counting operation upon detection of a sound in said predetermined time interval in said specified environment, said counter means being adapted to disable and cease a counting operation after said predetermined time interval if no sound occurs during the predetermined time interval, said counter means also being adapted to initialize a counting operation to restart the predetermined time interval upon detection of each new sound, (d) output circuit means operatively connected to said counter means and having means for coupling to an electrically operable device to control the electrical power delivered to an electrically operable device in response to the occurrance of sound within, said predetermined time interval, such that the electrically operable device is de-energized if no sound was detected during the predetermined time interval and energization of such device is maintained if sound occurred during the predetermined time interval and such device is re-energized upon detection of new sound after the predetermined time interval.

* * * * *